US009745725B2

(12) United States Patent
Wang et al.

(10) Patent No.: US 9,745,725 B2
(45) Date of Patent: Aug. 29, 2017

(54) APPARATUS FOR IMPROVING EXCAVATING OPERATION CHARACTERISTIC AND GRADING OPERATION CHARACTERISTIC OF EXCAVATOR

(71) Applicant: XCMG EXCAVATOR MACHINERY CO., LTD, Xuzhou (CN)

(72) Inventors: Yong Wang, Xuzhou (CN); Hong Zhang, Xuzhou (CN); Shengxia Zhang, Xuzhou (CN); Kai Liu, Xuzhou (CN); Zong Li, Xuzhou (CN); Jian Zhang, Xuzhou (CN); Mingjun Liao, Xuzhou (CN); Jiasheng Qin, Xuzhou (CN); Yufeng Yang, Xuzhou (CN)

(73) Assignee: XCMG EXCAVATOR MACHINERY CO., LTD, Xuzhou (CN)

( * ) Notice: Subject to any disclaimer, the term of this patent is extended or adjusted under 35 U.S.C. 154(b) by 951 days.

(21) Appl. No.: 13/933,134

(22) Filed: Jul. 2, 2013

(65) Prior Publication Data

US 2014/0007962 A1 Jan. 9, 2014

(30) Foreign Application Priority Data

Jan. 11, 2011 (CN) ..... 2011 1 0003934

(51) Int. Cl.

| | |
|---|---|
| ***E02F 9/22*** | (2006.01) |
| ***F15B 11/17*** | (2006.01) |
| ***E02F 3/43*** | (2006.01) |

(52) U.S. Cl.

CPC ..... *E02F 9/2278* (2013.01); *E02F 3/435* (2013.01); *E02F 9/2242* (2013.01); (Continued)

(58) Field of Classification Search

CPC ..... E02F 3/433; E02F 3/432; E02F 9/2292; E02F 9/2285; E02F 3/43; E02F 9/2239; E02F 3/844; F15B 11/17; F16D 31/02

(Continued)

(56) References Cited

U.S. PATENT DOCUMENTS 4,875,337 A * 10/1989 Sugiyama ..... E02F 9/2239 414/699

5,970,709 A * 10/1999 Tohji ..... E02F 9/2242 60/421

(Continued)

FOREIGN PATENT DOCUMENTS

KR 1020090044942 * 12/2010 ..... F15B 11/17

*Primary Examiner* — F. Daniel Lopez
*Assistant Examiner* — Richard Drake

(57) ABSTRACT

Disclosed is an apparatus for improving excavating operation characteristic and grading operation characteristic of an excavator. The apparatus includes a solenoid valve group and a hydraulically controlled selector valve. An oil controlling output A1 of the solenoid valve group is configured in series with oil controlling input a1 of the hydraulic control valve. An oil controlling output A2 of the solenoid valve group is configured in series with a pilot control end XBa2 of a multi-port valve group. An oil return port T1 of the solenoid valve group is connected to the hydraulic oil tank. An oil controlling output b1 of the hydraulically controlled selector valve is connected to a pilot control end XAb2 of the multiplexer valve group, and an oil return port T2 of the hydraulically controlled selector valve is connected with the hydraulic oil tank. The apparatus improves operational efficiency and control comfortability.

5 Claims, 5 Drawing Sheets

(52) U.S. Cl.
CPC ..... *E02F 9/2282* (2013.01); *E02F 9/2285* (2013.01); *E02F 9/2292* (2013.01); *E02F 9/2296* (2013.01); *F15B 11/17* (2013.01); *F15B 2211/20546* (2013.01); *F15B 2211/20576* (2013.01); *F15B 2211/3116* (2013.01); *Y10T 137/86131* (2015.04); *Y10T 137/86493* (2015.04)

(58) Field of Classification Search
USPC ..... 60/484, 486, 421; 137/1, 565.29, 625; 91/520
See application file for complete search history.

(56) References Cited

U.S. PATENT DOCUMENTS

| | | | | |
|---|---|---|---|---|
| 6,050,090 | A * | 4/2000 | Tohji | E02F 9/2203 60/421 |
| 6,708,490 | B2 * | 3/2004 | Toji | E02F 9/2239 60/421 |
| 7,178,333 | B2 * | 2/2007 | Oka | E02F 9/2239 60/421 |
| 7,356,991 | B2 * | 4/2008 | Kim | E02F 9/2282 60/421 |
| 8,146,355 | B2 * | 4/2012 | Lee | B62D 11/001 60/421 |
| 8,387,376 | B2 * | 3/2013 | Son | F15B 11/17 60/394 |
| 8,424,301 | B2 * | 4/2013 | Choi | B66C 23/44 60/421 |
| 2008/0078174 | A1 * | 4/2008 | Horii | E02F 9/2239 60/421 |

* cited by examiner

APPARATUS FOR IMPROVING EXCAVATING OPERATION CHARACTERISTIC AND GRADING OPERATION CHARACTERISTIC OF EXCAVATOR

CROSS-REFERENCES TO RELATED APPLICATIONS

This application claims the priority to International Application No. PCT/CN2012/070195, filed on Jan. 10, 2012, which claims priority to Chinese Patent Application No. 201110003934.7, filed on Jan. 11, 2011, the entire contents of all of which are incorporated herein by reference.

FIELD OF THE DISCLOSURE

The present disclosure relates to the field of hydraulic circuit apparatus technology including an excavator operation apparatus and, more particularly, relates to an apparatus for improving excavating operation characteristic and grading operation characteristic of an excavator.

BACKGROUND

A hydraulic excavator is currently widely used in occasions of building constructions such as housing foundation excavation and backfilling, pipeline laying and farmland water resource construction. An excavator has advantages in allowing flexible construction and having high execution efficiency. A hydraulic excavator is mainly configured by components such as a work device, a rotation mechanism, a travel mechanism, a rotating platform, and a hydraulic control device. Lifting and lowering of a boom, extending and contracting of a stick, rotating of a bucket and rotating of a rotary device are all realized by the control device to control a multiplexer valve group to allocate hydraulic oil supplied to hydraulic pumps via a hydraulic circuit. An excavating operation at a construction site usually involves a combination of a long-time excavating operation and a land grading operation. Therefore, under the premise of not affecting operation efficiency, both excavating operation characteristic and grading operation characteristic of an excavator are highly demanded by an operator.

The so-called excavating operation characteristic refers to a comprehensive judgment regarding stability, smoothness, and maneuver responsiveness of an excavator during an excavating operation. Among these, the smoothness and the maneuver responsiveness of the excavating operation are of most concern to an operator. A reasonable ratio of movement speeds of a boom cylinder and a stick cylinder of an excavator directly determines the excavating operation characteristic of the excavator and directly affects use efficiency of the excavator and operation experience of the operator. Best matching of cylinder movement speeds is achieved by controlling the openings/closings and a degree of opening of a valve spool of a hydraulic control valve via pilot oil of a hydraulic control system of the excavator. A valve corresponding to the valve spool is opened to connect to an oil passage of a main pump. Controlling over extension and contraction and a speed of a cylinder movement are achieved by connecting oil passages and by controlling flow rates of the oil passages.

During an excavating operation of a conventional excavator, a work device has a large acceleration. A sudden stop at a high speed or a sudden start is often accompanied with large shaking and rocking of the whole excavator, which affects comfortability and smoothness of an excavating operation of an excavator and increases tiredness of an operator and thus affects operation efficiency. Lifetime of an excavator operating under such a condition is reduced. Further, frequent switching of a hydraulic pump between no-load and high-load states increases engine load. Fuel consumption and operating costs both increase.

Grading operation characteristic of an excavator is an important use characteristic after the excavating operation characteristic, and is mainly used in the following work conditions: excavating a trench for pipe laying; land grading, slope repairing, and the like. In a conventional technology, the grading operation characteristic of an excavator can be directly linked to design parameters of the excavator. Once a product design is completed, movement speeds of a boom cylinder, a stick cylinder and a bucket cylinder are fixed. Therefore, during a land grading operation, the movement speed of the boom, stick and bucket is a constant parameter. A conventional excavator has the following problems during a land grading operation: Boom lifting is too fast; reciprocating speed of a stick is poor; and the bucket speed is not coordinated and synchronized with a combined movement of the boom and the stick. Thus, performance of a grading operation is directly affected.

During a grading operation, a main reason for slow lifting of a boom is that, in a conventional design, an oil supply method of using double pump confluence is adopted for increase excavating speed of a bucket. In double pump oil supply, oil is simultaneously supplied to a boom cylinder, a stick cylinder and a bucket cylinder. When an excavator performs a lifting operation during excavating or trenching, since a large amount of hydraulic oil is lost too early due to confluence of the bucket cylinder, amount of hydraulic oil supplied to the boom cylinder is reduced, causing uncoordinated moving speeds. In fact, directly adding a corresponding flow control valve in a circuit of the boom cylinder, the stick cylinder and the bucket cylinder can also adjust to some extent a combined operation effect of an executing element to alleviate a speed mismatch problem. However, because a size of a flow-control orifice is hard to be reasonably determined, effects obtained by adopting this method do not provide generalized significance. In addition, this method increases complexities and difficulties in pipeline design and adjustment, and occupies the limited control pipeline of a control valve.

BRIEF SUMMARY OF THE DISCLOSURE

Technical Solutions

To solve the above-described problems in conventional technologies, the present disclosure provides an apparatus for improving the excavating operation characteristic and grading operation characteristic of an excavator to improve comfortability during excavating operation and grading operation without causing negative effects on operation efficiency.

To achieve the above object, the present disclosure provides an apparatus for improving excavating operation characteristic and grading operation characteristic of an excavator. The disclosed apparatus includes a double hydraulic pump, a gear pump, a hydraulic oil tank, a right control lever valve, a left control lever valve, a multiplexer valve group, a stick cylinder, and a boom cylinder. The double hydraulic pump and the gear pump are configured in series by a mechanical connecting means and then connected to an oil inlet $B_1$ at one end.

The other end of the oil inlet $B_1$ is connected to the hydraulic oil tank. OH passages $P_1$ and $P_2$ of the double hydraulic pump are connected to an input port of the multiplexer valve group. Aa1 of the multiplexer valve group is connected to a rod-less chamber of the stick cylinder, Ba1 of the multiplexer valve group is connected to a rod chamber of the stick cylinder; Ab1 of the multiplexer valve group is connected to a rod-less chamber of the boom cylinder; and Bb1 of the multiplexer valve group is connected to a rod chamber of the boom cylinder.

An oil return port $R_2$ of the multiplexer valve group is connected to the hydraulic oil tank. An oil controlling output $A_3$ of the gear pump is configured in parallel respectively with $P_R$ end of the right control lever valve and $P_L$ end of the left control lever valve. $T_R$ end of the right control lever valve is configured in parallel with $T_L$ end of the left control lever valve and then connected with the hydraulic oil tank in series.

The disclosed apparatus also includes a solenoid valve group and a hydraulically controlled selector valve. The right control lever valve is configured, via a BOOM UP end, in parallel with an oil controlling inlet P1 of the solenoid valve group and a pilot control end XBb1 of the multiplexer valve group. The left control lever valve is configured, via an ARM DUMP end, in parallel with an oil controlling inlet P2 of the solenoid valve group and a pilot control end XBa1 of the multiplexer valve group. An oil controlling output A1 of the solenoid valve group is configured in series with oil controlling input a1 of the hydraulic control valve. An oil controlling output A2 of the solenoid valve group is configured in series with a pilot control end XBa2 of the multi-port valve group. An oil return port T1 of the solenoid valve group is connected to the hydraulic oil tank.

The left control lever valve is configured, via an ARM CROWD end, in parallel with pilot control ends XAa2 and XAa1 of the multiplexer valve group and a pressure detecting end a2 of the hydraulically controlled selector valve. An oil controlling output b1 of the hydraulically controlled selector valve is connected to a pilot control end XAb2 of the multiplexer valve group. An oil return port T2 of the hydraulically controlled selector valve is connected with the hydraulic oil tank.

Operation Principle

A set of pressure-adjustable hydraulically controlled selector valves is added. Connection and disconnection of a corresponding control circuit is controlled by varying change-direction of the hydraulically controlled selector valve, thereby changing a changeless confluence oil supply mode in the conventional technology. By changing the confluence mode, reasonable allocation of a flow of a main pump is realized. Thereby, utilization efficiency of the flow of the main pump during stick excavation is improved, and power utilization efficiency of an engine is improved. By selectively connecting and disconnecting boom confluence, hydraulic impact during boom lifting is reduced, thereby improving operator comfortability during operation. An operator can intentionally select between an excavating operation mode and grading operation mode.

The solenoid valve group is controlled to change a confluence control circuit to selectively enhance a fast reciprocating movement function of a stick that is required in a grading operation while reducing hydraulic flow in a boom lifting circuit. This reduces a hydraulic impact, improves comfortability during a grading operation, and achieves the best land grading effect at a lowest level of complexity.

Industrial Applicability and Advantageous Effects

Beneficial effects of the present disclosure include the following. In the excavating operation and the grading operation, various actions can be coordinated and synchronized. Utilization efficiency and operational comfortability of the excavator can be improved while reducing production and maintenance costs and significantly improving operation efficiency.

It is to be understood that both the foregoing general description and the following detailed description are exemplary and explanatory only and are not restrictive of the disclosure, as claimed. Other aspects of the present disclosure can be understood by those skilled in the art in light of the description, the claims, and the drawings of the present disclosure.

REFERENCE SIGN LIST

Figure 1:
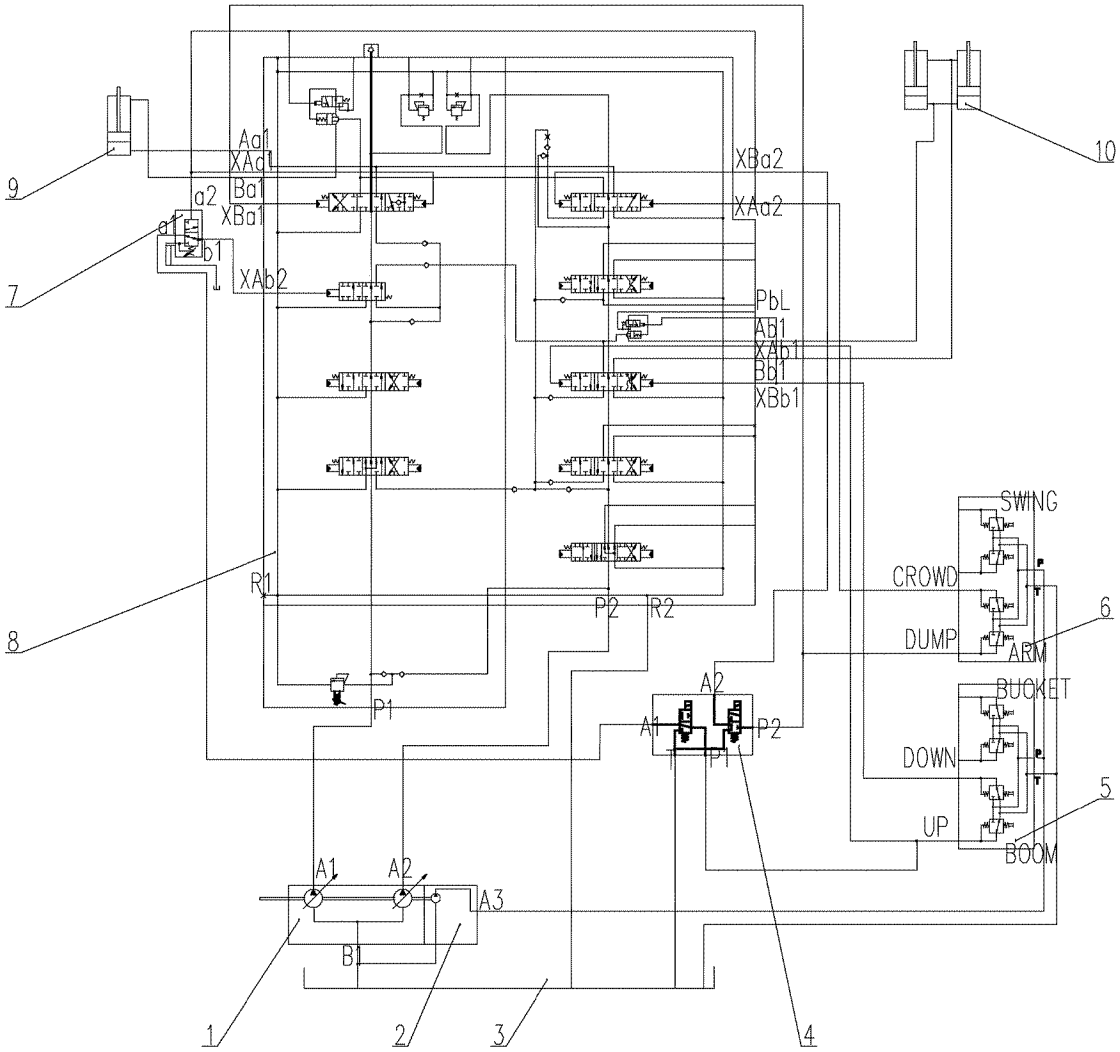
FIG. 1 is a schematic diagram illustrating a hydraulic process in accordance with various disclosed embodiments.

Double hydraulic pump 1
Gear pump 2
Hydraulic oil tank 3
Solenoid valve group 4
Right control lever valve 5
Left control lever valve 6
Hydraulically controlled selector valve 7
Multiplexer valve group 8
Stick cylinder 9
Boom cylinder 10

DETAILED DESCRIPTION

Reference will now be made in detail to exemplary embodiments of the disclosure, which are illustrated in the accompanying drawings. Wherever possible, the same reference numbers will be used throughout the drawings to refer to the same or like parts.

Figure 2:
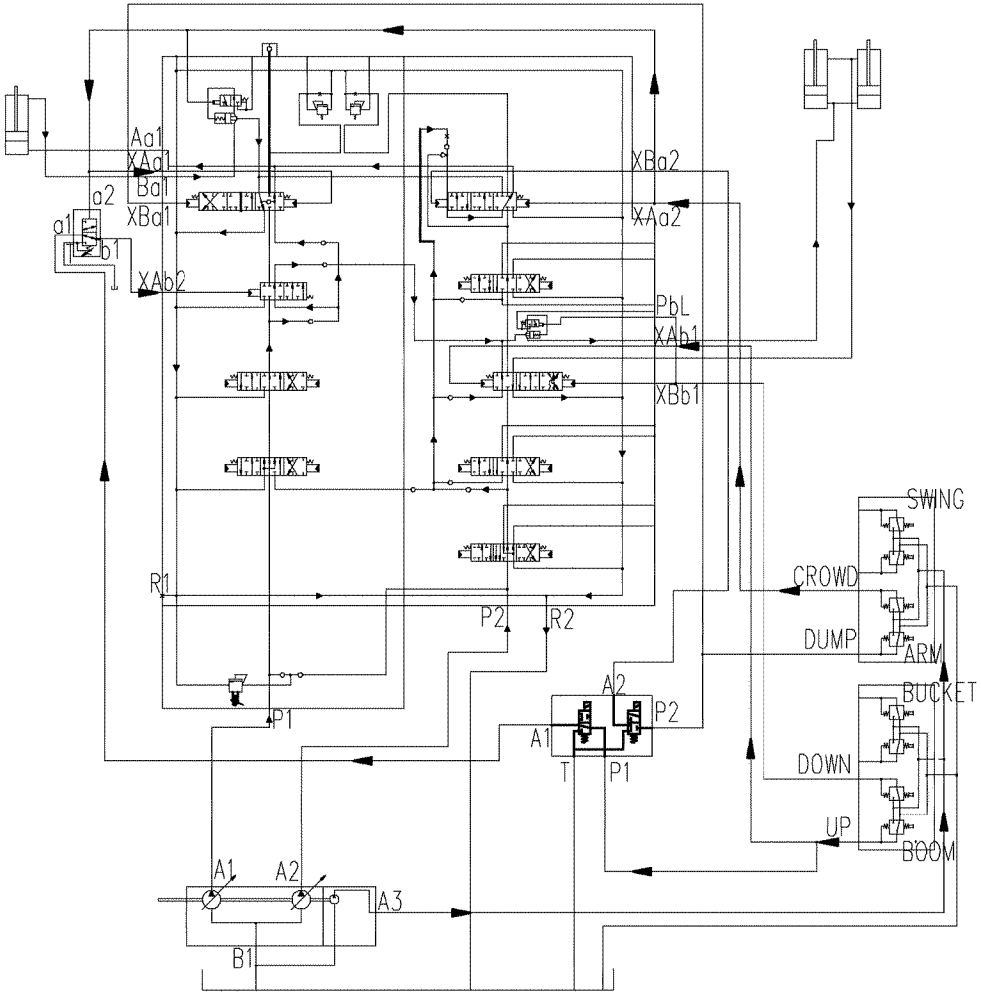
FIG. 2 is schematic diagram illustrating flow directions of hydraulic oil passages in a standard excavation mode when a hydraulically controlled selector valve does not change direction in accordance with various disclosed embodiments.
Figure 3:
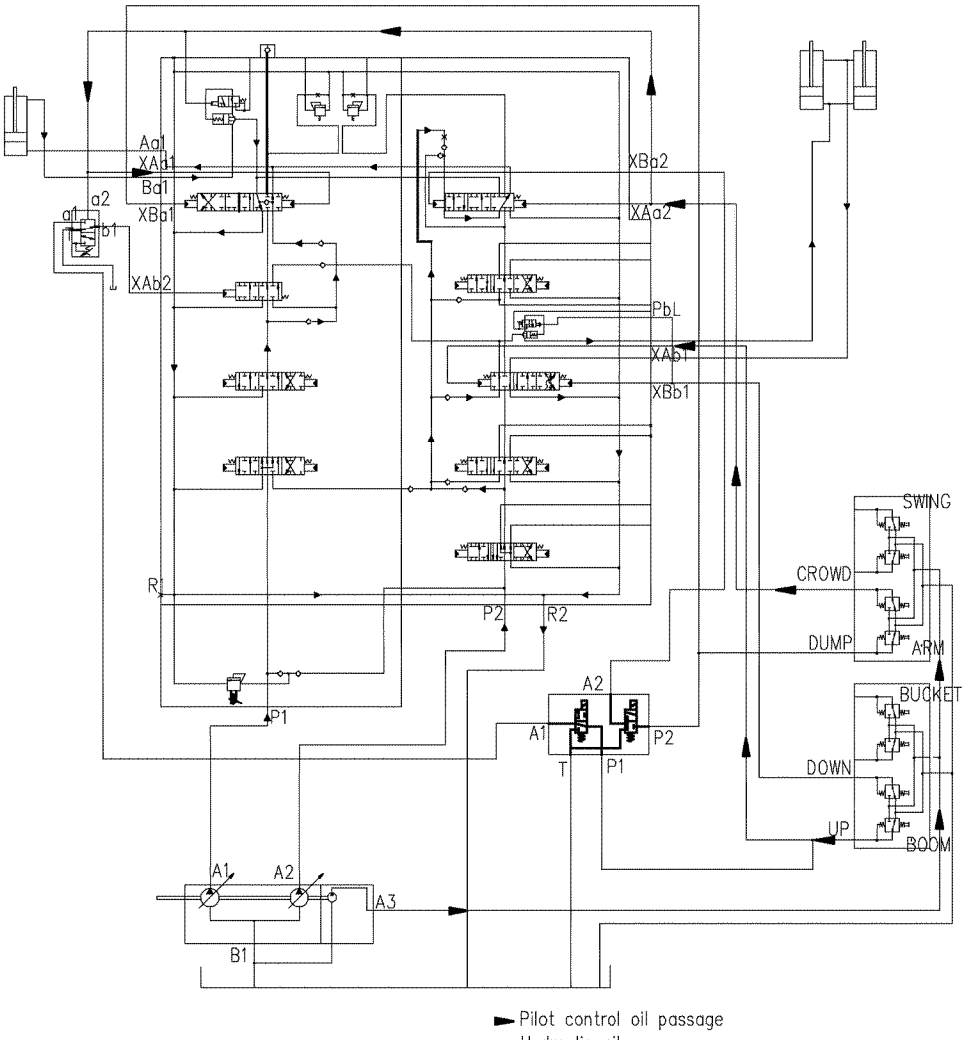
FIG. 3 is schematic diagram illustrating flow directions of hydraulic oil passages in a standard excavation mode when the hydraulically controlled selector valve changes direction in accordance with various disclosed embodiments.
Figure 4:
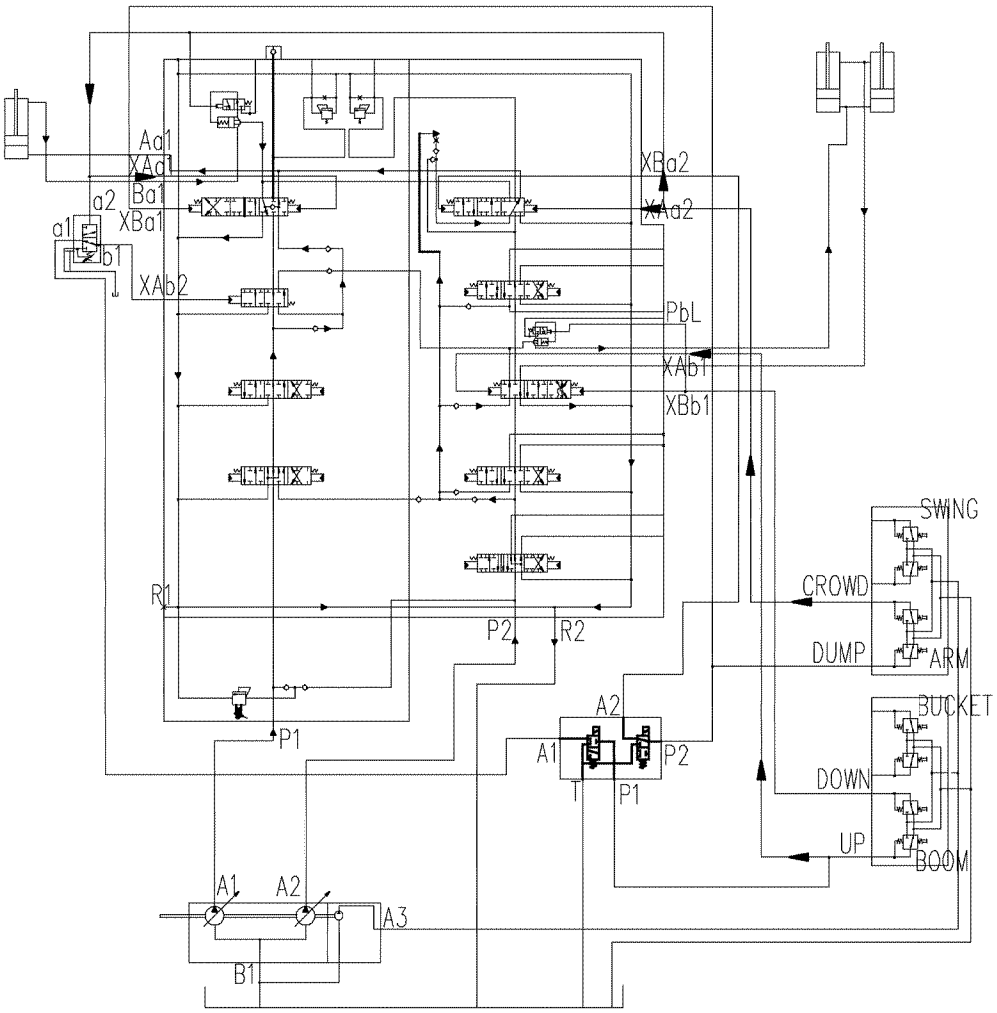
FIG. 4 is a schematic diagram illustrating flow directions of hydraulic oil passages in a grading operation mode during a stick excavation operation in accordance with various disclosed embodiments.
Figure 5:
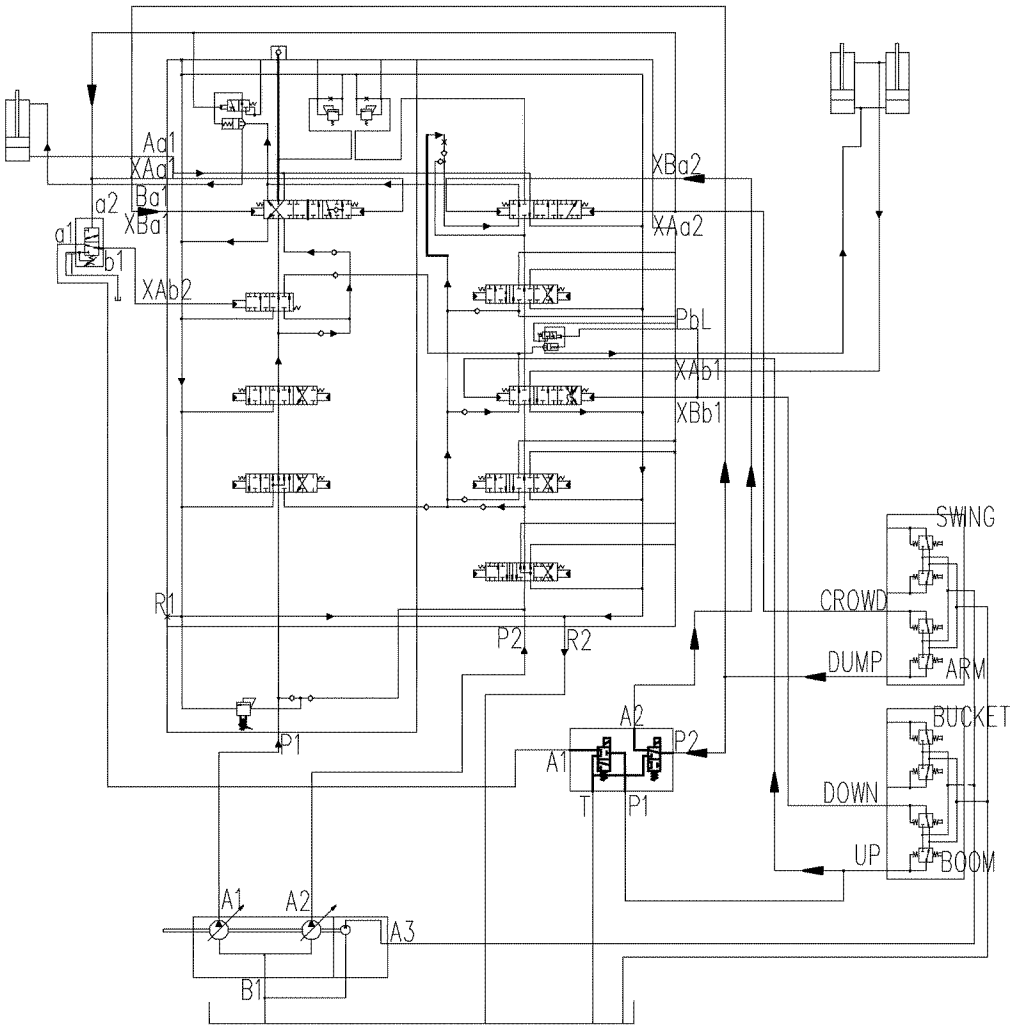
FIG. 5 is a schematic diagram illustrating flow directions of hydraulic oil passages in a grading operation mode during a stick swing operation in accordance with various disclosed embodiments.

As shown FIGS. 1-5, the disclosed apparatus includes a double hydraulic pump 1, a gear pump 2, a hydraulic oil tank 3, a right control lever valve 5, a left control lever valve 6, a multiplexer valve group 8, a stick cylinder 9, and a boom cylinder 10.

The double hydraulic pump 1 and the gear pump 2 are configured in series by a mechanical connecting means and then connected to an oil inlet $B_1$ at one end. The other end of the oil net $B_1$ is connected to the hydraulic oil tank 3. OH passages $P_1$ and $P_2$ of the double hydraulic pump 1 are connected to an input port of the multiplexer valve group 8. Aa1 of the multiplexer valve group 8 is connected to a rod-less chamber of the slick cylinder 9, Ba1 of the multiplexer valve group 8 is connected to a rod chamber of the stick cylinder 9; Ab1 of the multiplexer valve group 8 is connected to a rod-less chamber of the boom cylinder 10; and Bb1 of the multiplexer valve group 8 is connected to a rod chamber of the boom cylinder 10.

An oil return port $R_2$ of the multiplexer valve group 8 is connected to the hydraulic oil tank 3. An oil controlling output $A_3$ of the gear pump 2 is configured in parallel respectively with $P_R$ end of the right control lever valve 5 and $P_L$ end of the left control lever valve 6. $T_R$ end of the right control lever valve 5 is configured in parallel with $T_L$ end of the left control lever valve 6 and then connected with the hydraulic oil tank 3 in series.

The disclosed apparatus also includes a solenoid valve group 4 and a hydraulically controlled selector valve 7. The right control lever valve 5 is configured, via a BOOM UP end, in parallel with an oil controlling inlet P1 of the solenoid valve group 4 and a pilot control end XBa1 of the multiplexer valve group 8. The left control lever valve 6 is configured, via an ARM DUMP end, in parallel with an oil controlling inlet P2 of the solenoid valve group 4 and a pilot control end XBa1 of the multiplexer valve group 8. An oil controlling output A1 of the solenoid valve group 4 is configured in series with oil controlling input a1 of the hydraulic control valve 7.

An oil controlling output A2 of the solenoid valve group 4 is configured in series with a pilot control end XBa2 of the multi-port valve group 8. An oil return port T1 of the solenoid valve group 4 is connected to the hydraulic oil tank 3. The left control lever valve 6 is configured, via an ARM CROWD end, in parallel with pilot control ends XAa2 and XAa1 of the multiplexer valve group 8 and a pressure detecting end a2 of the hydraulically controlled selector valve 7.

An oil controlling output b1 of the hydraulically controlled selector valve 7 is connected to a pilot control end XAb2 of the multiplexer valve group 8. An oil return port T2 of the hydraulically controlled selector valve 7 is connected with the hydraulic oil tank 3.

An electrical signal controlling end of the solenoid valve group 4 is connected with a controller. Via commands from an operator, a switching between a disconnected mode and a connected mode of the solenoid valve group 4 is achieved. When the controller sends out a signal to connect the solenoid valve group 4, the solenoid valve group 4 disconnects a boom lifting confluence circuit and increases a stick swinging confluence circuit to achieve a grading operation mode. When the controller sends out a signal to disconnect the solenoid valve group 4, a valve spool is restored to a middle position, a boom lifting confluence circuit is restored, and a stick swinging confluence circuit is disconnected to perform a standard excavation mode.

When entering a standard excavation mode, a pressure detecting end of the hydraulically controlled selector valve 7 detects a control pressure signal of a stick excavation. When a control pressure value of the stick excavation is smaller than a change-direction pressure of the hydraulically controlled selector valve 7, the hydraulically controlled selector valve 7 does not change its direction. Hydraulic oil of a pilot control oil passage controlling a boom cylinder 10 and a stick cylinder 9 is entirely supplied by a double pump after confluence. When the control pressure value of the stick excavation reaches the change-direction pressure of the hydraulically controlled selector valve 7, the hydraulically controlled selector valve 7 changes its direction, a boom confluence control circuit is disconnected and oil is independently supplied to a boom by a single pump, while a stick excavation double pump confluence circuit is maintained. In this manner, power utilization efficiency of a hydraulic pump is achieved and hydraulic oil of the hydraulic pump is more allocated to the stick cylinder to perform the excavation operation.

When entering a grading operation mode, an operator may change a control mode by sending the controller a change-direction command to the solenoid valve group 4 via an operational button. After receiving the command, the solenoid valve group 4 changes its direction, the pilot control oil passage changes allocation of a double pump confluence, a confluence control circuit of boom lifting (e.g., a piston rod of boom cylinder extends out) hydraulic oil is disconnected and is replaced by using a single pump to supply oil, stick excavation (e.g., a piston rod of the stick cylinder 9 extends out) maintains double pump confluence, and a hydraulic oil passage of stick swinging (e.g., a piston rod of the stick cylinder 9 recovers) is increased with the double pump confluence. Speed for recovering the stick cylinder is improved to achieve fast reciprocating speed of the stick during grading operation. Because boom lifting confluence is cancelled and boom lifting is steady, impact of traffic to the boom is reduced to achieve requirements for smooth and fine grading operation.

Other applications, advantages, alternations, modifications, or equivalents to the disclosed embodiments are obvious to those skilled in the art.

What is claimed is:

1. An apparatus for improving excavating operation characteristic and grading operation characteristic of an excavator including a boom, a stick, and a bucket, the apparatus comprising:

a hydraulic oil tank (3), a right control lever valve (5), a left control lever valve (6), a multiplexer valve group (8), a solenoid valve group (4) and a hydraulically controlled selector valve (7), wherein:

the right control lever valve (5) has a BOOM UP end functioned to control the boom to be up, and is connected with each of: an oil controlling inlet (P1) of the solenoid valve group (4) and a pilot control end (XBb1) of the multiplexer valve group (8), that are configured in parallel;

the left control lever valve (6) has an ARM DUMP end functioned to control the stick to dump, and connected with each of: an oil controlling inlet (P2) of the solenoid valve group (4) and a pilot control end (XBa1) of the multiplexer valve group (8), that are configured in parallel; and an oil controlling output (A1) of the solenoid valve group (4) is configured in series with an oil controlling input (a1) of the hydraulic control valve (7), an oil controlling output (A2) of the solenoid valve group (4) is configured in series with a pilot control end (XBa2) of the multiplexer valve group (8), and an oil return port (T1) of the solenoid valve group (4) is connected to the hydraulic oil tank (3);

the hydraulically controlled selector valve (7) is configured in a boom confluence control circuit to control the boom operation and configured to detect a control pressure signal of a stick excavation; and the hydraulically controlled selector valve (7) is configured to detect the control pressure signal of the stick excavation during the excavation operation, and configured to disconnect the boom confluence control circuit, while a double pump confluence circuit corresponding to a double hydraulic pump (1) is used only for the stick excavation, based on the control pressure value of the stick excavation.

2. The apparatus of claim 1, wherein:

the left control lever valve (6) is configured, via an ARM CROWD end, to connect with each of: pilot control ends (XAa2) and (XAa1) of the multiplexer valve group (8) and a pressure detecting end (a2) of the hydraulically controlled selector valve (7), that are configured in parallel; and an oil controlling output (b1) of the hydraulically controlled selector valve (7) is connected to a pilot control end (XAb2) of the multiplexer valve group (8), and an oil return port (T2) of the hydraulically controlled selector valve (7) is connected with the hydraulic oil tank (3).

3. The apparatus of claim 1, further comprising a double hydraulic pump (1), a gear pump (2), a stick cylinder (9), and a boom cylinder (10), wherein:

the double hydraulic pump (1) and the gear pump (2) are configured in series by a mechanical connecting mechanism and then connected to an oil inlet ($B_1$) at one end, an other end of the oil inlet ($B_1$) is connected to the hydraulic oil tank (3), and oil passages ($P_1$) and ($P_2$) of the double hydraulic pump (1) are connected to an input port of the multiplexer valve group (8), (Aa1) of the multiplexer valve group (8) is connected to a rod-less chamber of the stick cylinder (9), (Ba1) of the multiplexer valve group (8) is connected to a rod chamber of the stick cylinder (9), (Ab1) of the multiplexer valve group (8) is connected to a rod-less chamber of the boom cylinder (10), and (Bb1) of the multiplexer valve group (8) is connected to a rod chamber of the boom cylinder (10), an oil return port ($R_2$) of the multiplexer valve group (8) is connected to the hydraulic oil tank (3).

4. The apparatus of claim 3, wherein:

an oil controlling output ($A_3$) of the gear pump (2) is respectively connected with each of: ($P_R$) end of the right control lever valve (5) and ($P_L$) end of the left control lever valve (6), that are configured in parallel, and $T_R$ end of the right control lever valve (5) is configured in parallel with ($T_L$) end of the left control lever valve (6) and then connected with the hydraulic oil tank (3) in series.

5. The apparatus of claim 1, wherein:

the solenoid valve group (4) is configured to control: both the boom confluence control circuit and a stick confluence control circuit, to allow the excavator to switch between an excavation operation and a grading operation, in response to a control signal received by the solenoid valve group (4).

* * * * *